US010561204B2

(12) United States Patent
Ha et al.

(10) Patent No.: US 10,561,204 B2
(45) Date of Patent: Feb. 18, 2020

(54) WIRE TIGHTENING DEVICE AND PROVIDING METHOD THEREFOR

(71) Applicant: SHIN KYUNG INC., Busan (KR)

(72) Inventors: Ki Ho Ha, Busan (KR); Young Ho Ha, Busan (KR)

(73) Assignee: SHIN KYUNG INC., Busan (KR)

( * ) Notice: Subject to any disclaimer, the term of this patent is extended or adjusted under 35 U.S.C. 154(b) by 478 days.

(21) Appl. No.: 14/916,287

(22) PCT Filed: Sep. 2, 2014

(86) PCT No.: PCT/KR2014/008178

§ 371 (c)(1),
(2) Date: Mar. 3, 2016

(87) PCT Pub. No.: WO2015/034233

PCT Pub. Date: Mar. 12, 2015

(65) Prior Publication Data

US 2016/0213099 A1 Jul. 28, 2016

(30) Foreign Application Priority Data

Sep. 3, 2013 (KR) ..... 10-2013-0105488

(51) Int. Cl.
*A43C 11/16* (2006.01)

(52) U.S. Cl.
CPC ..... *A43C 11/165* (2013.01)

(58) Field of Classification Search
CPC ..... A43C 11/165; A43C 11/20; A43C 3/02; A43C 3/04

(Continued)

(56) References Cited

U.S. PATENT DOCUMENTS 3,108,385 A * 10/1963 Teufel ..... A43C 3/04 24/712.7
5,117,567 A * 6/1992 Berger ..... A43B 1/0072 36/50.1

(Continued)

FOREIGN PATENT DOCUMENTS

CN 101228567 A 7/2008
DE 9005496 U1 9/1991

(Continued)

OTHER PUBLICATIONS

International Search Report for PCT/KR2014/008178 dated Jan. 9, 2015.

*Primary Examiner* — Anne M Kozak
(74) *Attorney, Agent, or Firm* — STIP Law Group, LLC

(57) ABSTRACT

The present invention provides a wire tightening device for improving the convenience of use by readily providing the device in shoes, comprising: a housing part fixed to the tongue of shoes to provide a ratchet-type gear in the inner circumference thereof, and having a cylindrical inner surface; a reel part rotatably arranged inside the housing part and providing tensile force to a wire for tightening both side covers of the shoes as the wire is wound; and a rotary cover for selectively rotating the reel part, wherein the housing part provides a coupling part placed on the top surface of the tongue in a position corresponding to a provision hole formed in the tongue, and a pressing surface part for pressing the bottom surface of the tongue according to the coupling, to the coupling part, of the coupling bar protruding from one surface for clamping and fixing the tongue by penetrating through the provision hole.

7 Claims, 10 Drawing Sheets

(58) Field of Classification Search
USPC ..... 36/50.1
See application file for complete search history.

(56) References Cited

U.S. PATENT DOCUMENTS

| | | | | | |
|---|---|---|---|---|---|
| 5,177,882 | A * | 1/1993 | Berger | A43B 1/0072 | 36/50.1 |
| D333,552 | S * | 3/1993 | Berger | D2/973 | |
| 6,158,096 | A | 12/2000 | Bar | | |
| 6,289,558 | B1 | 9/2001 | Hammerslag | | |
| 2008/0196224 | A1* | 8/2008 | Hu | A43C 11/16 | 24/68 SK |
| 2011/0266384 | A1* | 11/2011 | Goodman | A43C 11/165 | 242/396.4 |

FOREIGN PATENT DOCUMENTS

| | | | |
|---|---|---|---|
| JP | H05509018 | A | 12/1993 |
| JP | 2007-330808 | A | 12/2007 |
| KR | 10-0807105 | B1 | 2/2008 |
| KR | 20-2011-0008203 | U | 8/2011 |
| KR | 10-2013-0028402 | A | 3/2013 |
| KR | 10-1249420 | B1 | 4/2013 |

* cited by examiner

WIRE TIGHTENING DEVICE AND PROVIDING METHOD THEREFOR

CROSS-REFERENCE TO RELATED APPLICATIONS

This application is the U.S. National Phase under 35 U.S.C. § 371 of International Application No. PCT/KR2014/008178 filed on Sep. 2, 2014, which in turn claims the benefit of Korean Application No. 10-2013-0105488, filed on Sep. 3, 2013, the disclosures of which are incorporated by reference into the present application.

TECHNICAL FIELD

The present invention relates to a wire tightening device and a providing method thereof, and in particular to a wire tightening device which can be easily mounted at shoes and a providing method thereof, thus enhancing convenience when in use.

BACKGROUND ART

The wire tightening device in general is being used for various applications, for example, it may be used to tighten a predetermined item. Among such various applications, an application to shoes is widely known and mentioned a lot, but the above wire tightening device could be applied to various items which are put on and tightened with the aid of a wire, for example, a head-mounted gear including a cap, a belt, gloves, a bag, a snowboard, a water ski, etc. in addition to the shoes.

The shoes, for example, sneakers, etc. are used in such a way to connect shoestrings in zigzag directions for the shoes to fit well in response to user's feet sizes. More specifically, the fitting between the shoes and the user's feet can be enhanced by tightening the shoestrings, whereupon the user can have more comfortable walking.

The sizes of the shoes should be chosen given if the shoes are easily took off or not during the walking. It is common that the user wears shoes, with the shoestrings being fixed a little loosened for the sake of easier wearing and taking off, but it is recommended for the sake of foot health that the user wears shoes with the shoestrings tightened to prevent the shoes from going loosened to the extent that the shoes are not took off during the walking.

Since tightening or untightening the shoestrings whenever the user wears and takes off the shoes cause a lot of inconvenience, the user in general wears the shoes with the shoestrings being appropriately tightened except for a special case. In this case, the user may stop walking and tie the shoestrings again if the shoestrings are untied or too loosened. Even though the shoestrings are not loosened, the shoes may not look neat since ends of the shoestrings are not fixed.

Tightening and untightening the shoestrings are not easy for elementary school students or kids younger than those students or old men and women. In case of a mountain climber or an athlete of a bike racing, etc., the shoestrings ends of which are not fixed may be untied as they are hooked by a certain thing during the intense actions, whereupon a racing record may be degraded or an accident may occur. For this reason, it is important to prevent the loosening of the shoestrings.

Moreover, since it needs to untie the tightly tied shoestrings during the resting for the sake of enough relaxation, it is preferred that the shoestrings should be easily tightened after relaxation, and the tightened state should last stable, and the tied shoestrings should be easily loosened.

The Korean patent registration No. 124920 discloses a device for tightening a wire wherein an elevating cam part is provided, which ascends or descends in response to the rotation direction of a rotary cover, and a reel part around which a wire is wound when the elevating cam part descends is configured to rotate integral with the rotary cover, thus tightening the wire, and when the elevating cam part ascends, the reel part will rotate independent with respect to the rotary cover, thus pulling and loosening the wire.

In the above wire tightening device, the process for tightening and untightening the shoestrings should be carried out in a state where the shoestrings are fixed to the tongues of the shoes. For this, an extension part is formed along a rim of a housing part of the shoestrings tightening device fixed at the tongue, and the tongue is sewed along a rim of the extension part.

In the above configuration, since it is impossible for a user to sew in person due to the thicknesses of the extension part and the tongue, the user should purchase shoes equipped with the shoestring tightening device, and a special repair tool is required to mount the shoestring tightening device at the shoes that the user wants. For this reason, the user should ask a special shop to mount the shoestring tightening device, which results in inconveniences.

DISCLOSURE OF INVENTION

Accordingly, the present invention is made in an effort to resolve the above problems. It is an object of the present invention to provide a device for tightening a wire and a mounting method thereof, which can be easily mounted on shoes, thus enhancing convenience when in use.

Technical Solution

To achieve the above object, there is provided a wire tightening device, which may include, but is not limited to, a housing part which is fixed at a tongue of a shoe, wherein a ratchet type gear is provided at an inner circumferential portion thereof, and includes a cylindrical inner surface; a reel part which is disposed rotatable at an inner portion of the housing part and is able to supply a tensile force to a wire to tighten side skins of both sides of the shoe as the wire is wound; and a rotary cover which is provided to selectively rotate the reel part, wherein the housing part is mounted on the upper surface of the tongue, and a coupling part is provided at a portion corresponding to a provision hole formed at the tongue, and the housing part includes a pressing surface part which will pressurize the lower surface of the tongue as a coupling bar protruding from one surface passes through and is engaged to the coupling part so as to fixedly clamp the tongue.

Here, the coupling part may include an insertion groove part into which the coupling bar is inserted, and a hooking protrusion which is protruding from an inner portion of the insertion groove part, wherein the lower surface of the hooking protrusion is formed inclined, and the upper surface thereof is formed flat, and a ratchet protrusion is formed protruding from the coupling bar, wherein the ratchet protrusion slides on the lower surface of the hooking protrusion and is mounted on the upper surface of the hooking protrusion and is hooked and restricted.

At this time, either the hooking protrusion or the ratchet protrusion is formed in a multiple-step structure in response to the direction that the coupling bar is inserted, and a wedge protrusion is formed protruding from the lower surface of the housing part and from the upper surface of the pressing surface part so as to pressurize and restrict by gripping the tongue.

Moreover, the coupling part includes an coupling surface part formed extending along a rim of a lower end of the housing part, and a hooking shoulder which is formed along an inner circumferential portion of a binding hole formed at the coupling surface part, and the pressing surface part is extending along an outer end of the coupling surface part and is bent covering a side end portion of the tongue, and a fixing protrusion is protruding from a rim of an upper end of the coupling bar so that the coupling bar is inserted in the binding hole and is hooked and restricted by the hooking shoulder.

Furthermore, a guide part is engaged to each shoestring hole formed along the side skins of both sides of the shoe, and the guide part comprises a lower body part wherein an insertion protrusion passing through the shoestring hole is formed protruding, and is restricted by a rim of a lower portion of the shoestring hole, and an upper body part which is mounted on a rim of an upper portion of the shoestring hole, wherein an coupling hole to which the insertion protrusion is engaged is formed at one side thereof, and a wire guide hole is formed at the other side thereof in the direction vertical to the coupling hole in order for the wire is to be inserted.

Here, an inner surface of the wire guide hole is configured in such a way that a central portion thereof is formed protruding in the direction of the outside of the shoe in a bulged and rounded shape.

Moreover, a guide part is engaged to each pair of the shoestring holes which are formed on side skins of both sides of the shoe and are disposed facing each other, and the guide part is formed of a guide band which is disposed in such a way that both end portions thereof are exposed to the outsides of each pair of the shoestring holes, and the wire is engaged passing through both the end portions.

Furthermore, the pressing surface part is formed rounded in response to the top of a user's foot, and includes a cushion part which is provided on the lower surface of the pressing surface part and elastically transforms when it contacts with the top of the user's foot at a portion corresponding to the coupling bar, and the cushion part is formed protruding in a semispherical shape in order for the pressing surface part to be mounted on the upper side of the top of the foot.

To achieve the above objects, there is provided a method for mounting a wire tightening device, which may include, but is not limited to, a first step wherein a provision hole is formed at a tongue of a shoe at a previously set interval; a second step wherein a housing part is mounted on the upper surface of the tongue in order for a coupling part formed at the housing part to be disposed in response to a provision hole, wherein a reel part provided to supply a tensile force to the wire which is able to tighten side skins of both sides of the shoe as it is wound, is disposed rotatable at the housing part; and a third step wherein a coupling bar, which is formed protruding from the pressing surface part provided to pressurize the lower surface of the tongue in order for the tongue to be fixedly clamped, passes through the provision hole and is engaged to the coupling part.

Here, an end portion of the wire is connected to the reel part in order for the wire to which the guide part is engaged can be wound during the rotation of the reel part, and the third step includes a step wherein an upper body part of the guide part is disposed at a rim of an upper side of each shoestring hole formed on side skins of both sides of the shoe, and an insertion protrusion formed protruding from a lower body part passes through the shoestring hole and is engaged to the coupling hole of the upper body part in order for the lower body part of the guide part to be restricted by a rim of a lower portion of the shoestring hole.

Advantageous Effects

The device for tightening a wire and a mounting method thereof according to the present invention have the following advantageous effects.

First, according to the device for tightening a wire, a provision hole is formed at a tongue of a shoe, and a coupling part is disposed at a portion corresponding to the provision hole. The wire tightening device of the present invention can be mounted through an easy procedure wherein a coupling bar formed at a pressing surface part is inserted into the coupling part via the provision hole. For this reason, the wire tightening device of the present invention is compatible with various shoes, thus enhancing a product compatibility and mounting procedure.

Second, a latch protrusion formed at the coupling bar or an coupling protrusion formed at the coupling part is formed in a multiple-step structure, whereupon it can be inserted in stages, the tongue which may have various thicknesses can be pressurized stable without an additional sewing and can be fixed using a clamp, whereby the wire can be stably tightened or untightened, thus enhancing the stability of the product.

Third, the wire can be connected in a zigzag shape and fixed at a lateral skin of a shoe in such a way to engage a guide part connected to the wire to a shoestring hole, so convenience can be improved when in use, and since an inner side surface of a wire guide hole is formed inclined, a friction force with respect to the wire can decrease, and the top of a foot and toes can be evenly tightened, so a comfortable and stable wearing feeling can be provided.

Fourth, a cushion part which can be elastically transformed is provided on a lower surface of the pressing surface part, the top of a user's foot can be supported comfortable when the wire is tightened. Moreover, the cushion part which is disposed in parallel protruding in a semispherical shape is able to support both protruding sides of the top of the foot, any leaning outward of the top of the tongue can be prevented even though a predetermined time passes after the user wears the shoes, whereby a comfortable wearing feeling can be provided.

Fifth, the cushion part is supported by the top of the user's foot during the rotation of the rotary cover, whereupon the wire can be stably tightened since any movement of the tongue can be prevented. When the wire is loosened, the cushion part can be elastically recovered. Since a predetermined space is formed between the tongue and the top of the user's foot, the wire can be loosened by pulling the tongue, which makes it impossible to improve the convenience when in use.

BEST MODES FOR CARRYING OUT THE INVENTION

The wire tightening device may include, but is not limited to, a housing part which is fixed at a tongue of a shoe, wherein a ratchet type gear is provided at an inner circumferential portion thereof, and includes a cylindrical inner surface; a reel part which disposed rotatable at an inner portion of the housing part and is able to supply a tensile force to a wire to tighten side skins of both sides of the shoe as the wire is wound; and a rotary cover which is provided to selectively rotate the reel part, wherein the housing part is mounted on the upper surface of the tongue, and a coupling part is provided at a portion corresponding to a provision hole formed at the tongue, and the housing part includes a pressing surface part which will pressurize the lower surface of the tongue as a coupling bar protruding from one surface passes through and is engaged to the coupling part so as to fixedly clamp the tongue.

MODES FOR CARRYING OUT THE INVENTION

The wire tightening device according to a preferred embodiment of the present invention will be described with reference to the accompanying drawings.

Figure 1:
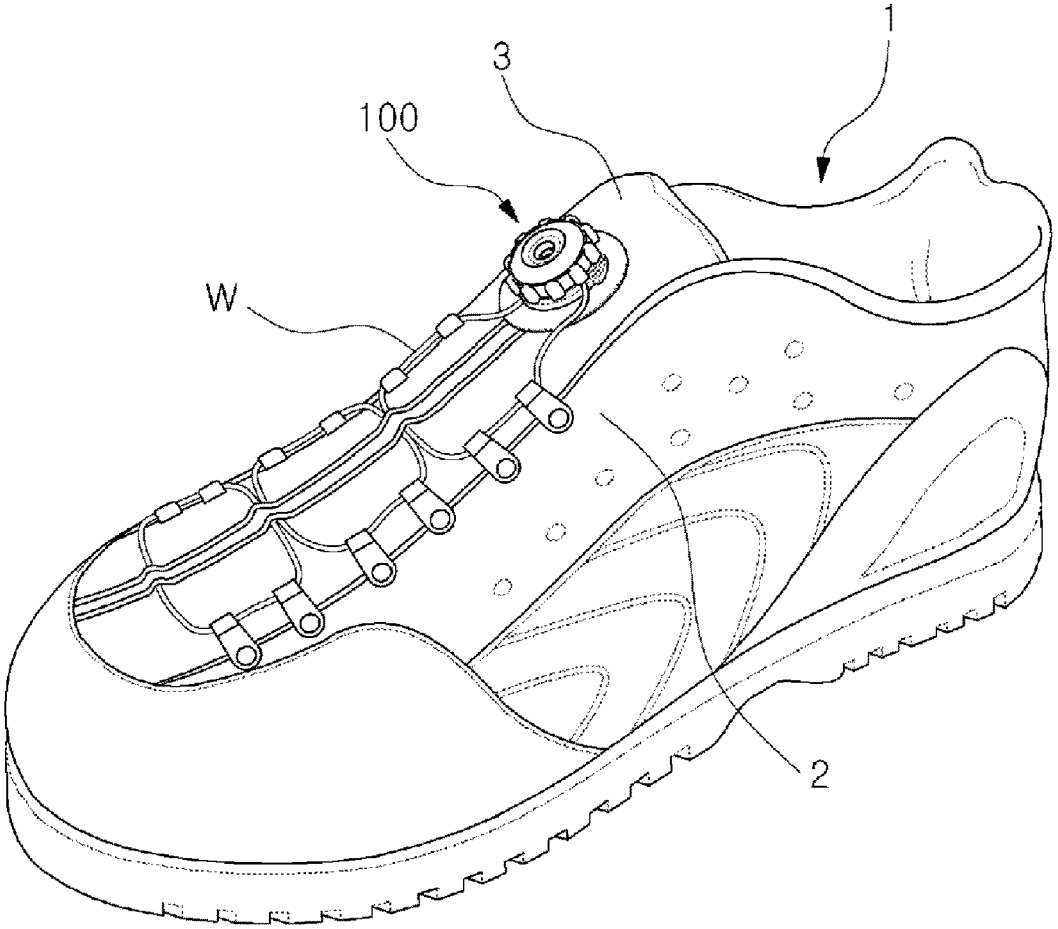
FIG. 1 is a perspective view illustrating a shoe on which a wire tightening device is mounted according to an embodiment of the present invention.
Figure 2:
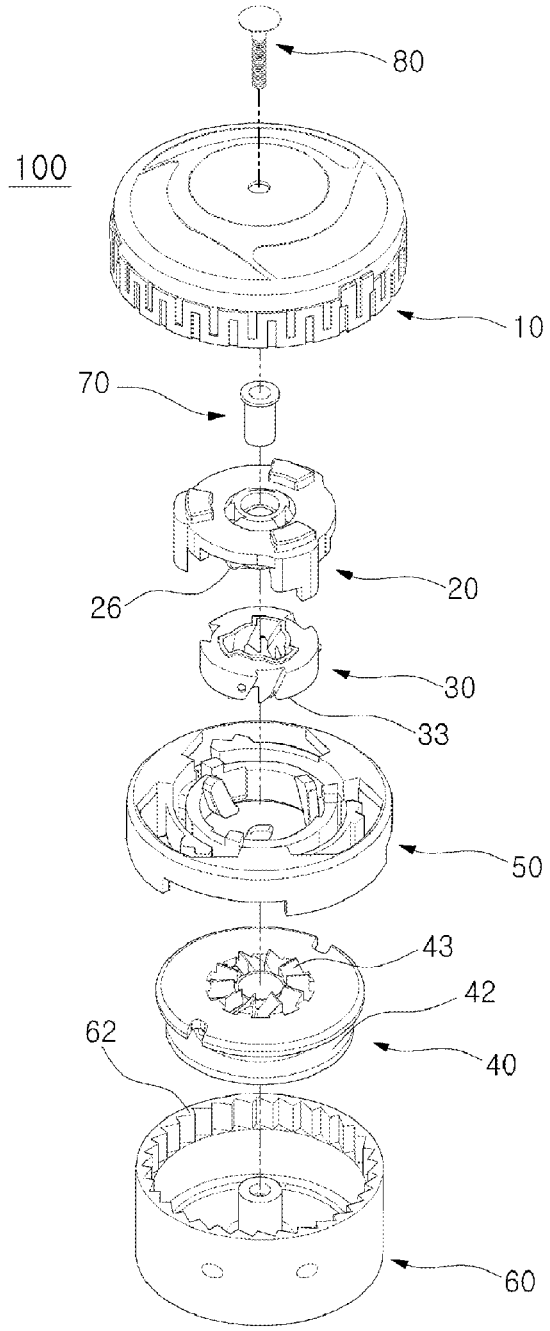
FIG. 2 is a disassembled perspective view illustrating a wire tightening device according to an embodiment of the present invention.

FIG. 1 is a perspective view illustrating a shoe on which a wire tightening to device is mounted according to an embodiment of the present invention. FIG. 2 is a disassembled perspective view illustrating a wire tightening device according to an embodiment of the present invention. Here, the wire tightening device 100 may apply to a device which is provided at shoes or a cap to help a user to wear or may apply to a tightening device which can be variously used for items, for example, clothes, accessory, an exercise equipment, etc. which could be put on in such a way to tighten a wire or a string, for example, a belt, gloves, a bag, a water ski, a snowboard, etc.

As illustrated in FIGS. 1 and 2, the wire tightening device 100 may be applied to tightening a wire (w) of shoes 1 or a cap. In case of the shoes 1, it is preferred that the wire tightening device 100 is attached to the upper surface of a tongue to which the wire (w) is connected. For the sake of a good design, etc., it could be attached to a side portion of the shoe 1.

The wire (w) is configured to be wound and tightened as the rotary cover of the wire tightening device 100 rotates. For this reason, the wire tightening device 100 of the present invention is able to allow a user to walk comfortably since the wire (w) can be appropriately tightened in response to the sizes including a user's foot width and height.

Referring to FIG. 2, the wire tightening device 100 may include, but is not limited to, a housing part 60, a reel part 40, and a rotary cover 10.

A ratchet type gear 62 is provided at an upper portion of the inner circumferential surface of the housing part 60, and the lower surface of the housing part 60 is fixed at the tongue of the shoe. Moreover, the housing part 60 may include a cylindrical inner space into which the reel part 40 is housed. A cam base part 50 is provided at an upper rim portion of the housing part 60.

The cam base part 50 may be connected rotatable to an upper rim portion of the housing part 60, and it is preferred that the rotation of the cam base part 50 in the counterclockwise direction is limited by the ratchet type gear 62.

Moreover, the reel part 40 is provided rotatable at an inner side of the housing part 60 and is able to provide a tensile force to the wire which is provided to tighten the side skin 2 of either side of the shoe 1 as it is wound. The reel part 40 is engaged to a rotary shaft and at a lower inner side of the housing part 60 and is disposed rotatable, and the cam base part 50 is disposed at an upper portion of the reel part 40.

Moreover, a cam driving part 20 is provided at an upper end of the cam base part 50. A protrusion portion is formed at the cam driving part 20, so the cam driving part 20 is preferably engaged to an inner circumferential portion of an elevating cam part 30.

The rotary cover 10 is engaged to an upper portion of the cam driving part 20 and is configured to rotate integrally, and it is preferred that a rim portion of the lower end of the rotary cover 10 is engaged to the cam base part 50.

An coupling screw 80 is passing through the rotary cover 10 and the rotary shaft 70 and is engaged to the housing part 60. Moreover, the rotary shaft 70 is disposed covering the coupling screw while passing through the reel part 40, the cam base part 50, the elevating cam part 30 and the cam driving part 20.

The elevating cam part 30 is housed at the inner circumferential portion of the cam base part 50. The elevating cam part 30 is able to ascend or descend in response to the rotation direction of the cam driving part 20, thus selectively coupling with the upper surface of the reel part 40.

Moreover, a ratchet type protrusion 43 is formed at the upper surface of the reel part 40 while protruding upward in the counterclockwise direction along the circumferential direction, and a slide protrusion 33 is formed protruding from a lower end of the elevating cam part 30 and is engaged shape-matching with the ratchet type protrusion 43.

The ratchet type protrusion 43 and the slide protrusion 33 are engaged or disengaged in response to the rotation direction of the cam driving part 20. Moreover, if the rotary cover 10 rotates in the clockwise direction, the elevating cam part 30 will descend by the cam driving part 20 which was integrally rotating, and is engaged to the reel part 40.

Here, since the elevating cam part 30 and the reel part 40 rotate integrally, the wire (w) can be wound. The wire (w) may be engaged to a portion of the reel part 40 and may be wound around a reel winding part 42 formed in a concave groove shape at a rim portion of the reel part 40.

Moreover, since the rotary cover 10 rotates in the counterclockwise direction, the elevating cam part 30 will ascend, and the reel part 40 will rotate independently, thus driving the wire (w) to be pulled and loosened.

Figure 3:
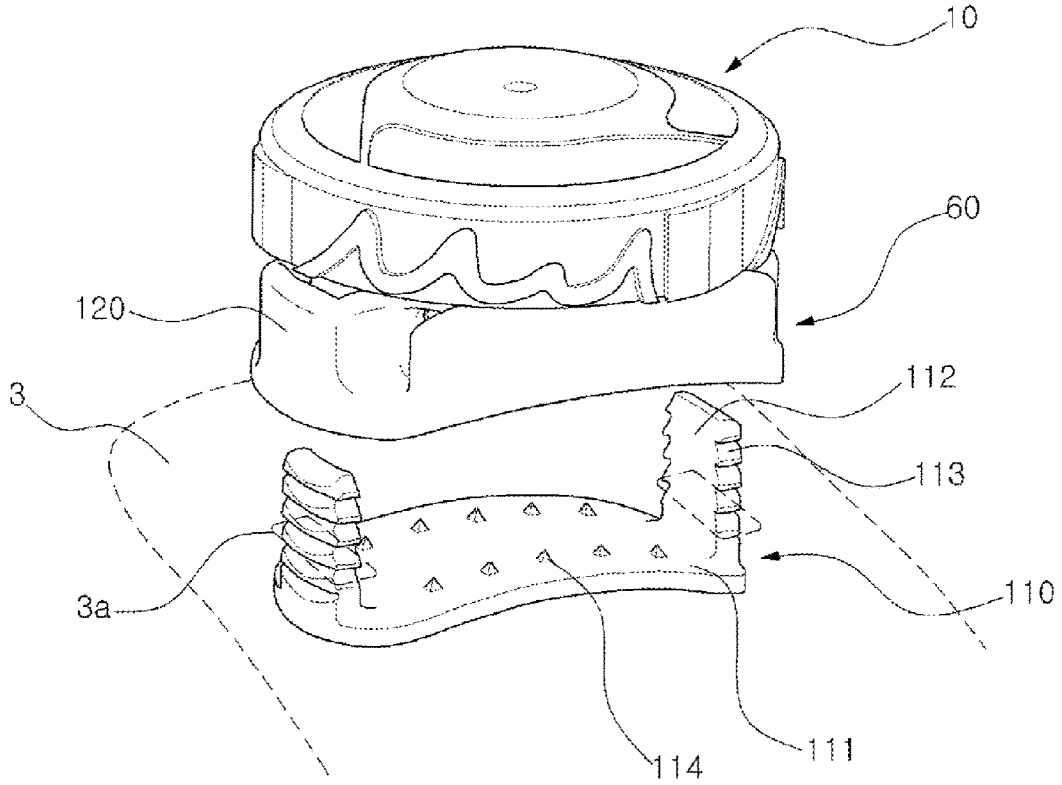
FIGS. 3 and 4 are perspective views illustrating an engagement of a wire tightening device according to an embodiment of the present invention.
Figure 4:
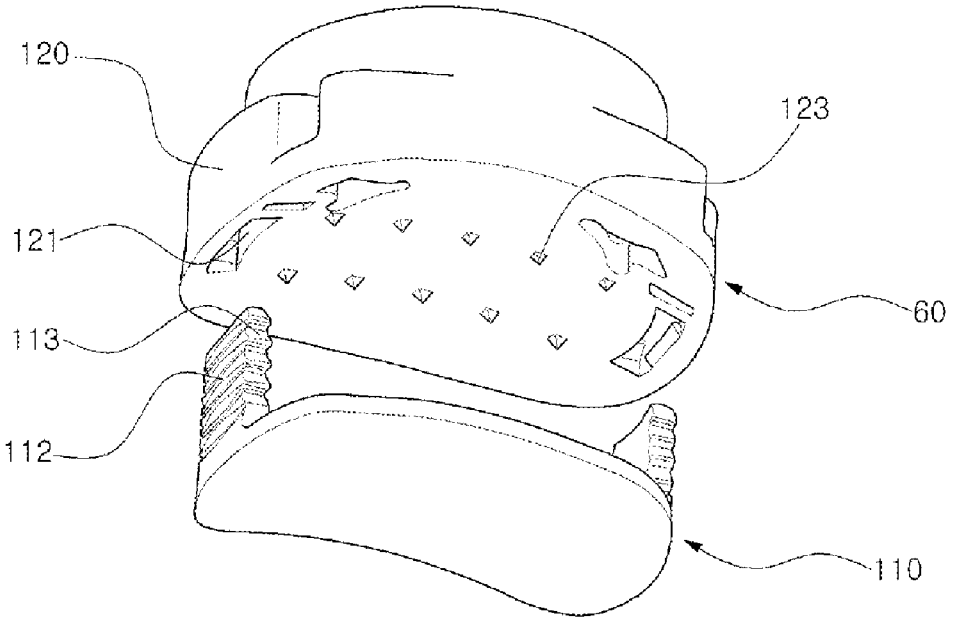
Figure 5:
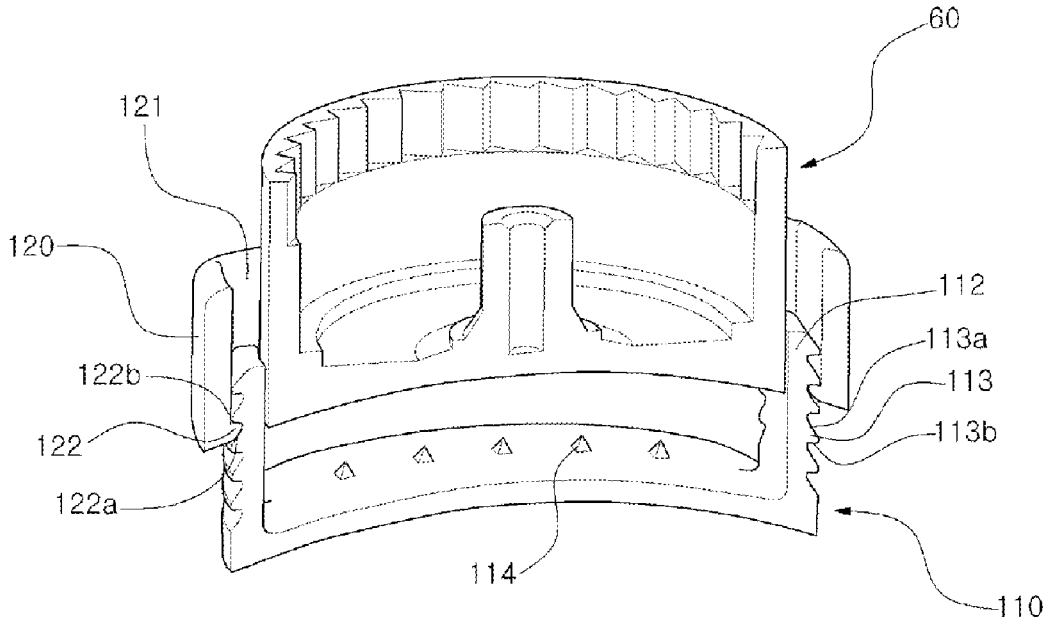
FIG. 5 is a cross sectional view illustrating an engagement of a wire tightening device according to an embodiment of the present invention.

FIGS. 3 and 4 are perspective views illustrating an engagement of a wire tightening device according to an embodiment of the present invention. FIG. 5 is a cross sectional view illustrating an engagement of a wire tightening device according to an embodiment of the present invention.

As illustrated in FIGS. 3 to 5, the wire tightening device may include a housing part 60 and a pressing surface part 110. Here, the housing part 60 is placed on the upper surface of the tongue 3, and a coupling part 120 is provided at a portion corresponding to a provision hole 3*a* formed at the tongue 3.

Moreover, the pressing surface part 110 will pressurize the lower surface of the tongue 3 since the coupling bar 112 installed protruding from one surface 11 to fixedly clamp the tongue 3 is engaged to the coupling part 120 via the provision hole 3*a*.

Referring to FIGS. 3 and 4, the coupling part 120 may include an insertion groove part 121 in which the coupling bar 112 is inserted, and an coupling protrusion 122 which is formed protruding from an inner portion of the insertion groove part 121, wherein the lower surface 122*a* thereof is formed inclined, and the upper surface 122*b* thereof is formed flat.

It is preferred that a ratchet protrusion 113 is formed protruding from the coupling bar 112 in such a way that the ratchet protrusion 113 is able to slide on the lower surface 122*a* of the coupling protrusion 122 when pressed downward toward the tongue and is restricted on the upper surface 122*b* of the coupling protrusion 122 when pulled upward, thus fixedly clamping the wire tightening device on the shoe.

Here, the coupling part 120 is formed at either side of the rim of the housing part 60, and the insertion groove part 121 is preferably formed at an inner portion of the coupling part 120. Here, the coupling protrusion 122 may be formed protruding from an inner and lower rim portion of the insertion groove part 121.

Moreover, the pressing surface part 110 is equipped with a plate member which is engaged to a lower end of the housing part 60 mounted on the upper surface of the tongue 3 and is provided to pressurize the lower surface of the tongue 3, thus fixedly clamping the tongue 3.

Since the pressing surface part 110 is disposed on the lower surface of the tongue 3 while contacting with the top of the feet of the user, it is preferred that the lower surface of the pressing surface part 110 is formed rounded to shape-match with the top of the foot, and it is preferably made of an elastic material to reduce any pressurization to the top of the foot.

The coupling bar 112 inserted in the insertion groove part 121 via the provision hole 3*a* may be formed protruding from the upper surface 111 of the pressing surface part 110. The ratchet protrusion 113 is formed protruding from the surface facing the coupling protrusion 122 formed protruding from an inner portion of the insertion groove part 121 so that the coupling bar 112 can be fixedly inserted under a lower portion of the insertion groove part 121.

It is preferred that either the coupling protrusion 122 or the ratchet protrusion 113 is formed in a multiple-step structure depending on the direction that the coupling bar 112 is inserted. In the preferred embodiment, an example where the ratchet protrusion 113 is formed in a multiple-step structure has been described, but the coupling protrusion 122 may be formed in a multiple-step structure or otherwise both the coupling protrusion 122 and the ratchet protrusion 113 may be formed in multiple-step structures.

Referring to FIG. 5, it is preferred that the ratchet protrusion 113 is formed with the upper surface 113*a* thereof being formed inclined, and the lower surface 113*b* thereof being formed horizontal. For this reason, when the coupling bar 112 passes through the provision hole 3*a* and is inserted under the insertion groove part 121, the ratchet protrusion 113 will pass through while sliding along the lower surface 122*a* of the coupling protrusion 122. Moreover, the ratchet protrusion 113 can be fixedly hooked without moving downward since the lower surface 133*b* of the ratchet 113 surface-contacts with the upper surface 122*a* of the coupling protrusion 122.

The lower surface of the housing part 60 and the upper surface of the pressing surface part 110 are able to fixedly clamp the tongue 3 in such a way that the housing part 60 is mounted on the upper surface of the tongue 3, and the pressing surface part 110 is disposed on the lower surface of the tongue 3, and the coupling bar 112 is inserted in the insertion groove part 121.

Since the tongue 3 can be pressurized and fixedly clamped stable between the housing part 60 and the pressing surface part 110 in such a way to just push the coupling bar 112 in the insertion groove part 121 via the provision hole 3*a* of the tongue 3, the convenience when in use can be greatly improved.

Furthermore, since either the coupling protrusion 122 or the ratchet protrusion 113 is formed in a multiple-step structure, they can be enhanced while adjusting the interval between the housing part 60 and the pressing surface part 110 in response to the thickness of the tongue 3. For this reason, they can be fixed stable in response to various thicknesses of the tongue 3, whereby the compatibility of the product can be improved.

Moreover, it is preferred that wedge protrusions 114 and 123 may be formed protruding from the lower surface of the housing part 60 and the upper surface of the pressing surface part 111 so as to pressurize and restrict the tongue 3. Here, since the housing part 60 and the pressing surface part 110 fixedly clamp the tongue 3, the wedge protrusions 114 and 123 are inserted inside while contacting with the upper and lower surfaces of the tongue 3 which have cushions, thus restricting the tongue 3 not to move leftward or rightward.

When the housing part 60 is fixed at the tongue 3, the pressure generated by the coupling bar 112 can be applied to an inner portion of the provision hole 3*a* during the procedure where the wire (w) is tightened by rotating the rotary cover 10. At this time, the provision hole 3*a* may be broken, and the tongue 3 may be torn apart, and the housing part 60 may separate from the tongue 3.

In order to prevent the above-mentioned situation, the wedge protrusions 114 and 123 are provided to reduce the pressure being applied to the provision hole 3*a* in such a way to restrict the upper and lower surfaces of the tongue 3, whereby the provision hole 3*a* can be protected while maintaining a stably engaged state.

Figure 6:
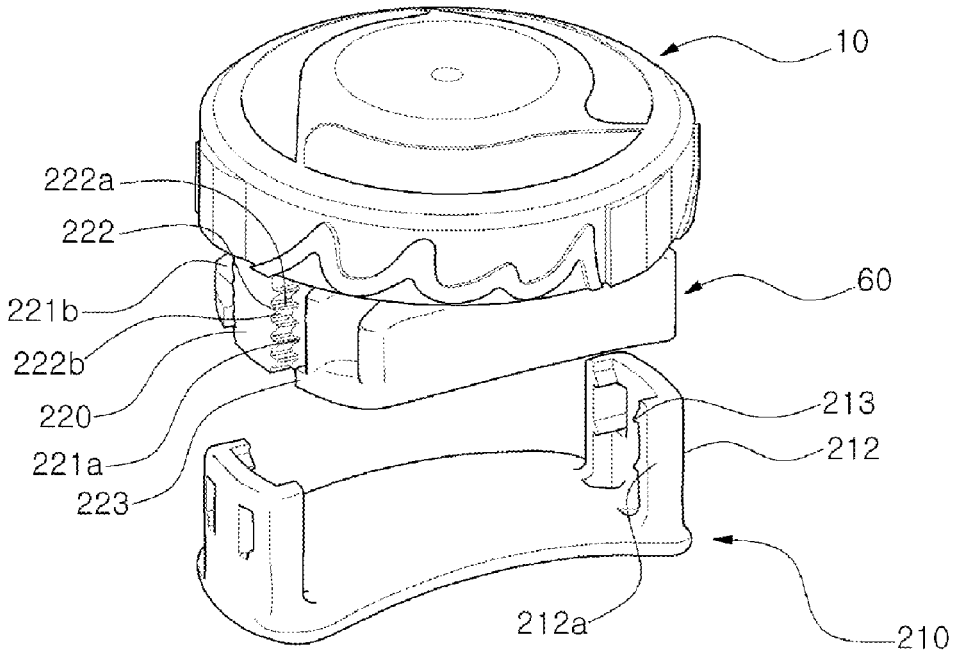
FIG. 6 is a perspective view illustrating an engagement of a wire tightening device according to another embodiment of the present invention.

Meanwhile, FIG. 6 is a perspective view illustrating an engagement of the wire tightening device according to another embodiment of the present invention. Since the basic configurations of the present embodiment except for the configurations of the insertion grooves 221*a* and 221*b* and the coupling bar 212 are same as the previously described configuration, the descriptions on the same components will be omitted.

As illustrated in FIG. 6, the coupling part 220 may include a front side insertion groove part 221*a* and a rear side insertion groove part 221*b*. Here, the inner portions of the insertion groove parts 221*a* and 221*b* are formed exposed from either side of the rim surface of the housing part 60, and each insertion groove part formed at either side may be formed a dual-step structurer at the front portion and the rear portion. Moreover, the coupling bar 212 is disposed with the ends 212*a* of either side being bent and fixedly inserted in the front side insertion groove part 221*a* and the rear side insertion groove part 221*b*.

An coupling protrusion 222 may be formed protruding from the front side insertion groove part 221*a* and the rear side insertion groove part 221*b* and along from the lower side to the upper side, wherein the end portion 212*a* of the coupling bar 212 is inserted in the lower side. Here, it is preferred that the coupling protrusion 222 is formed, with the lower surface 222*b* thereof being formed inclined, and the upper surface 222*a* thereof being formed flat.

Moreover, the ratchet protrusion 213 is formed protruding from an inner portion of the bent end portion 212*a* of the coupling bar 212 and is able to slide on the lower surface 222*b* of the coupling protrusion 222 and is mounted on the upper surface 222*a* of the coupling protrusion 222 and then is hooked and restricted.

It is preferred that the ratchet protrusion 213 is formed protruding with multiple steps and can be configured in such a way that a surface contact area where a restricting force generates as it is mounted on the upper surface 222*a* of the coupling protrusion 222 can increase. For this reason, the end portion 212*a* of the coupling bar 212 can be fixed stable without separating downward of the insertion groove parts 221*a* and 221*b*.

Furthermore, it is preferred that a support protrusion 223 is formed on the surface facing the surface from which the coupling protrusion 222 is protruding in the front side insertion groove part 221*a* and the rear side insertion groove part 221*b* so as to pressurize the end portion 212*a* of the inserted coupling bar 212 toward the coupling protrusion 222. For this reason, the ratchet protrusion 213 of the coupling bar 212 can be mounted and fixed stable without separating from the coupling protrusion 222.

Figure 7:
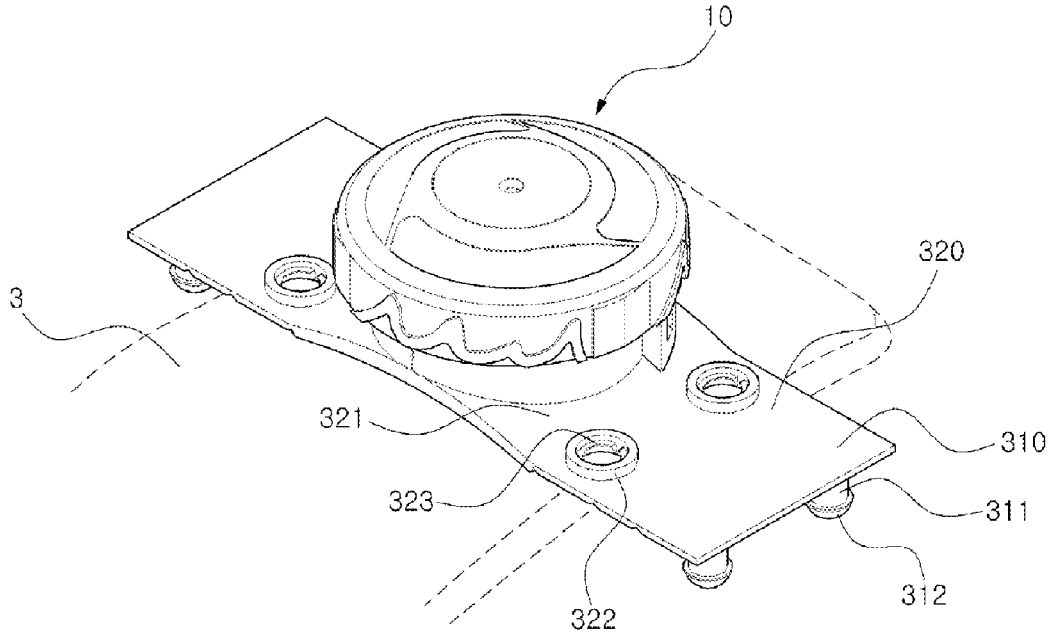
FIG. 7 is a perspective view illustrating an engagement of a wire tightening device according to further another embodiment of the present invention.
Figure 8:
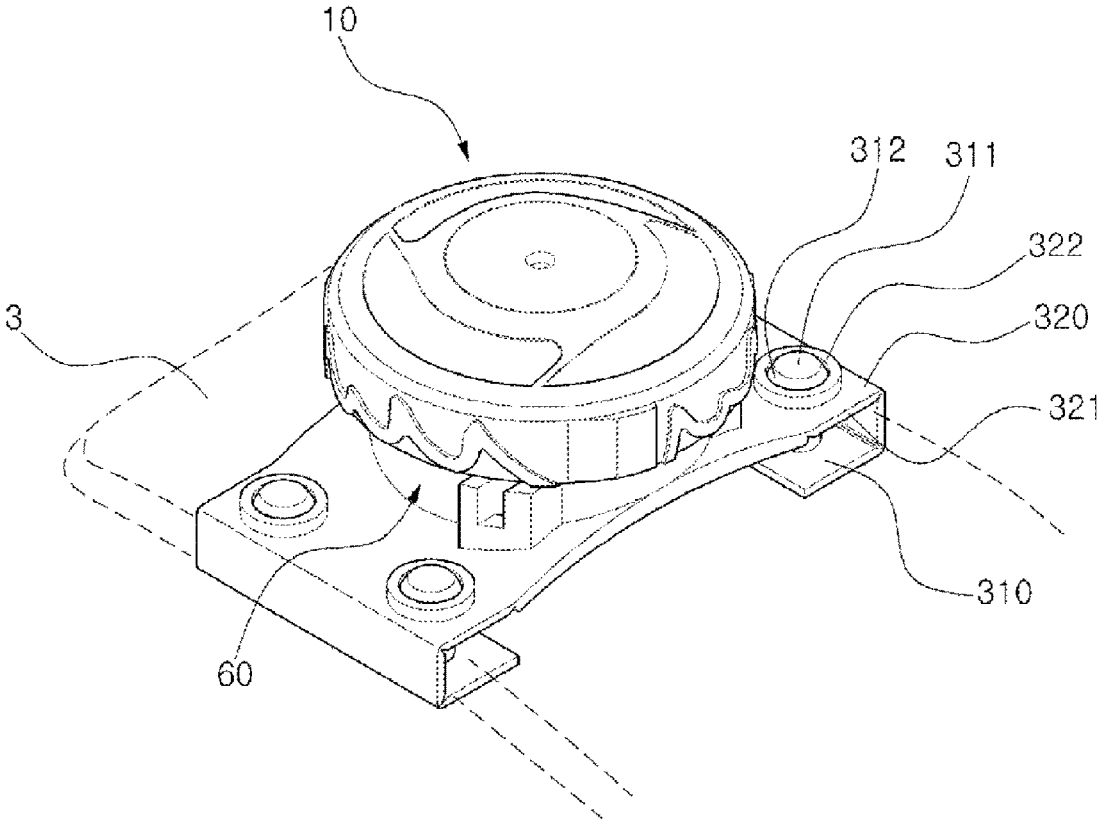
FIG. 8 is a side view illustrating an engagement of a wire tightening device according to further another embodiment of the present invention.

FIG. 7 is a perspective view illustrating an engagement of a wire tightening device according to further another embodiment of the present invention. FIG. 8 is a side view illustrating an engagement of a wire tightening device according to further another embodiment of the present invention.

In this embodiment, except for a configuration wherein a pressing surface part 310 is formed integral and bent at a coupling part 320, and a second coupling bar 311 is engaged to a binding hole 322 formed at the coupling part 320, the basic configurations are same as the previously described configurations, so the descriptions on the same components will be omitted.

Referring to FIGS. 7 and 8, the coupling part 320 may include, but is not limited to, an coupling surface part 321 which is formed extending along a rim of a lower end of the housing part 60, and a hooking shoulder 323 which is formed along an inner circumferential portion of a binding hole 322 formed at the coupling surface part 321.

Moreover, the pressing surface part 310 is formed extending along an outer end portion of the coupling surface part 321 and is bent covering a side end portion of the tongue 3, and the second coupling bar 311 is configured in such a way that a fixing protrusion 312 is formed protruding from a rim of an upper end so that it is inserted in the binding hole 322 and is engaged and restricted by the hooking shoulder 323.

More specifically, the coupling surface part 321 is formed extending from a rim of a lower end of the housing part 60 and will mount on the upper surface of the tongue 3. In the coupling surface part 321, the binding hole 322 may be formed at a portion corresponding to the provision hole 3*a* formed at the tongue 3.

The binding hole 322 may be formed in a dual-step structure at the front and rear portions of the coupling surface part 321, and the hooking shoulder 323 is preferably formed protruding along an inner circumferential portion of the binding hole 322. Moreover, the pressing surface part 310 formed extending along an outer end portion of the coupling surface part 321 may be bent covering the side end portion of the tongue 3.

Referring to FIG. 8, a second coupling bar 311 is bent at the pressing surface part 310 and is formed protruding from a portion corresponding to a lower end portion of the provision hole 3*a*, and since the second coupling bar 311 is bent covering a side end portion of the tongue 3, it can pass through the provision hole 3*a* and can be inserted into the binding hole 322. Moreover, since the fixing protrusion 312 is restricted by the hooking shoulder 323, the second coupling bar 311 can be fixed at the binding hole 322.

It is preferred that the second coupling bar 311 is provided in a dual-step structure corresponding to the binding hole 322 formed in a dual-step structure at the front and rear portions of the coupling surface part 321. The binding hole 322 and the second coupling bar 311 are not be limited to the dual-step structure, and may be formed in a multiple-step structure, for example, a triple-step or quad-step structure, and it may be disposed in parallel at a left or right side.

Moreover, in the second coupling bar 311, a fixing protrusion 312 may be formed protruding from a rim so as to be fixedly hooked by the coupling shoulder 323 formed on an inner circumferential portion of the binding hole 332. Here, it is preferred that the fixing protrusion 312 is provided in a multiple-step structure in the upward and downward directions of the second coupling bar 311.

The second coupling bar 311 can be hooked and fixed in such a way that it is simply inserted in the biding hole 322 via the provision hole 3*a*. Since it is inserted in a multiple-step way, the interval between the coupling surface part 321 and the pressing surface part 310 can be adjusted in response to the thickness of the tongue 3, so it can be fixed stable in response to various thicknesses of the tongue 3, thus improving product compatibilities.

Moreover, the pressing surface part 310 is provided covering a side end portion of the tongue 3, and the side end portion of the tongue 3 can be fixedly clamped between the pressing surface part 310 and the coupling surface part 321, whereby the housing part 60 can be fixed stable, not moving leftward or rightward.

The second coupling bar 311 is of course formed circular, and it is preferred that the provision hole 3*a* is formed in a circle sized for the second coupling bar 311 to pass through. The provision hole 3*a*, therefore, won't be torn apart while stably maintaining a fixed state even when pressure is applied to the provision hole 3*a* due to the pressure which is applied to the housing part 60 when the wire (w) is tightened or loosened.

Figure 9:
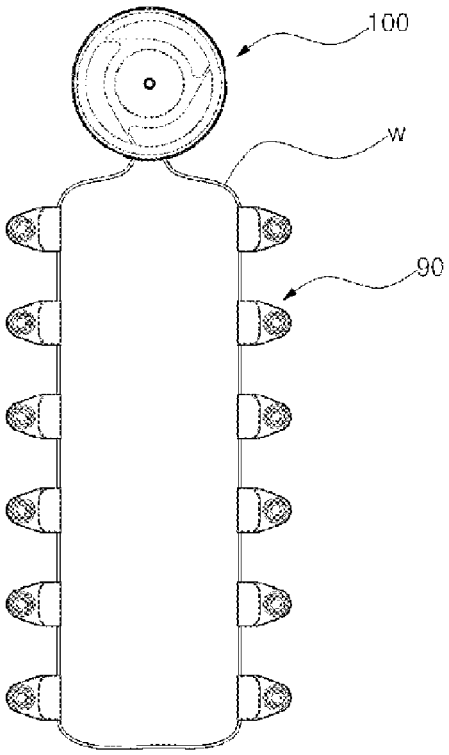
FIG. 9 is a plane view illustrating a state before a wire tightening device is mounted on a shoe according to an embodiment of the present invention.
Figure 10:
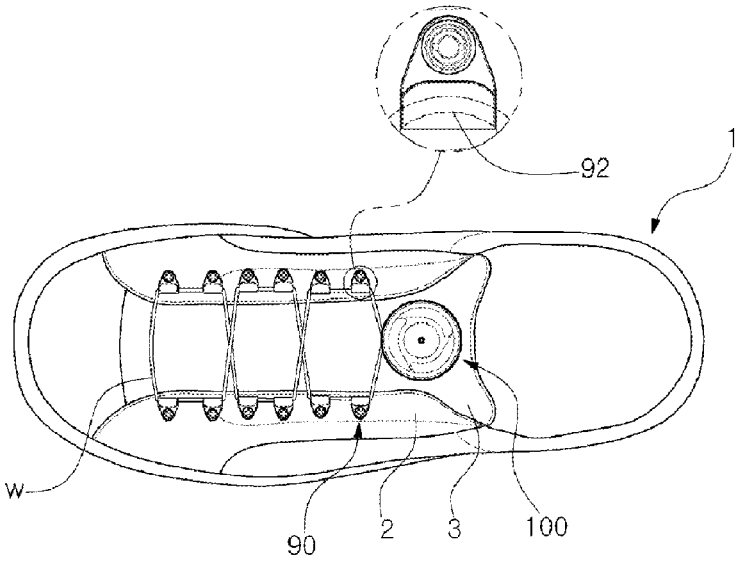
FIG. 10 is a plane view illustrating a configuration wherein a guide part of a wire tightening device is mounted on a shoe according to an embodiment of the present invention.
Figure 11:
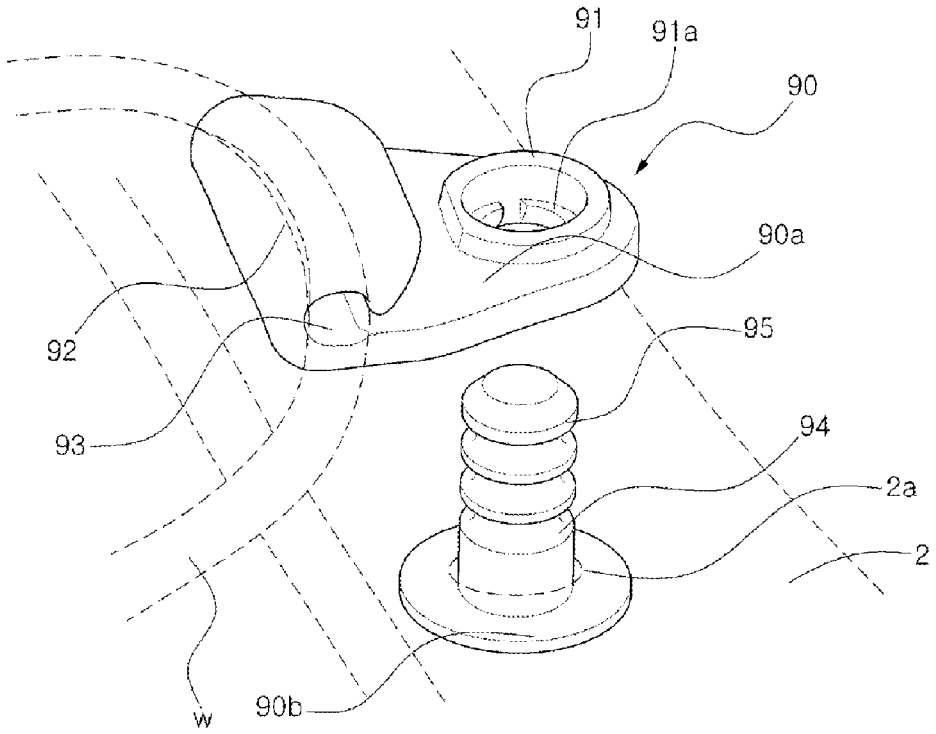
FIG. 11 is a perspective view illustrating a guide part of a wire tightening device according to an embodiment of the present invention.
Figure 12:
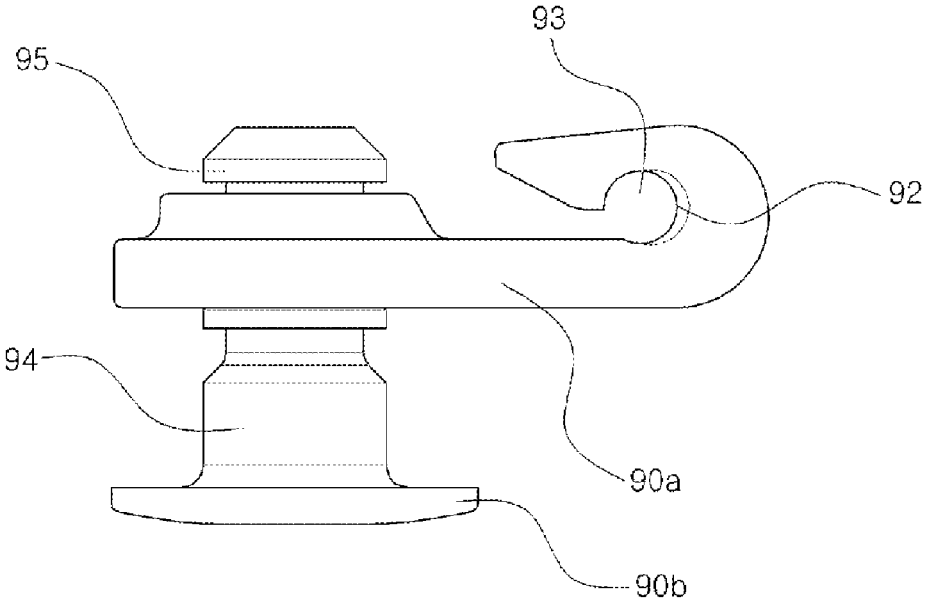
FIG. 12 is a side view illustrating a guide part of a wire tightening device according to an embodiment of the present invention.

FIG. 9 is a plane view illustrating a state before a wire tightening device is mounted on a shoe according to an embodiment of the present invention. FIG. 10 is a plane view illustrating a configuration wherein a guide part of a wire tightening device is mounted on a shoe according to an embodiment of the present invention. FIG. 11 is a perspective view illustrating a guide part of a wire tightening device according to an embodiment of the present invention. FIG. 12 is a side view illustrating a guide part of a wire tightening device according to an embodiment of the present invention.

Referring to FIGS. 9 and 10, the shoe 1 is equipped with shoestring holes 2*a* along the side skins 2 of either side thereof, and the guide part 90 is engaged to each shoestring hole 2*a* so as to guide the wire (w).

More specifically, the shoe 1 in general is equipped with the shoestring holes 2*a* into which a common shoestring is inserted, and the wire tightening device 100 is equipped with a wire (w) instead of the common shoestring, wherein the wire (w) is wound around the reel part 40, thus adjusting the interval between the side skins 2 of either side thereof.

The wire (w) may allow to adjust the interval between the side skins 2 of either side using a tensile force applied as the reel part 40 rotates, thus providing a wearing feeling based on the foot size of the wearer.

In case of an ordinary shoe, six pairs of the shoestring holes 2*a* are provided facing each other at the side skins 2 of either side. The guide part 90 is engaged to each shoestring hole 2*a*, and it is preferred that the wire (w) is connected in a zigzag shape in a form where two guide parts 50 are grouped as a pair which are disposed downward and upward along the side skin 2 of one side.

The wire (w) is inserted into two guide parts 90 which are disposed upward and downward at the top of the side skin 2 of one side, and passes through two guide parts 90 which are disposed upward and downward at an intermediate portion of the side skin of the other side and is inserted into two guide parts 90 disposed upward and downward at the bottom of the side skin 2 of one side.

Alternatively, the wire (w) may be connected in a zigzag shape as it is inserted into two guide parts 90 disposed upward and downward at the bottom of the side skin of the other side, and pass through two guide parts 90 disposed upward and downward at an intermediate portion of the side skin 2 of one side, and is inserted into two guide parts 90 disposed upward and downward at the top of the side skin of the other side. Here, it is preferred that both ends of the wire (w) are engaged and wound around the reel part 40.

As the wire (w) is wound in response to the rotation of the reel part 40, the side skins of both sides can be tightened inward. At this time, since each guide part 90 carries out a support function in such a way that two guide parts are distributing the pressure which is applied from the outer side to the inner side of the shoe, the wire (w) is able to stably support without separating from the shoestring hole 2*a* even though the tensile force applied to the wire (w) is over 60 kgf.

Referring to FIGS. 11 and 12, the guide part 90 may include a lower body part 90*b* and an upper body part 90*a*. It is preferred that the lower body part 90*b* may be restricted by a lower rim of the shoestring hole 2, and an insertion protrusion 94 passing through the shoestring hole 2 is formed protruding.

The upper body part 90*a* may be mounted on an upper rim of the shoestring hole 2, and an coupling hole 91 to which the insertion protrusion 94 is engaged may be formed at a portion thereof. Here, the coupling hole 91 may be preferably formed in response to the direction of the shoestring hole 2.

If the upper body part 90*a* is mounted on the upper rim of the shoestring hole 2, the insertion protrusion 94 of the lower body part 90*b* disposed at the lower rim of the shoestring hole 2 will pass through the insertion protrusion 94 of the lower body part 90*b* and will be fixedly inserted in the coupling hole 91.

It is, of course, preferred that a fixing shoulder 91*a* is provided in the circumferential direction at a circumferential portion of the coupling hole 91, and a fixing shoulder hooking protrusion 95 which is hooked by the fixing shoulder 91*a* is provided at the insertion protrusion 94.

Since the fixing shoulder hooking protrusion 95 is provided in a multiple-step structure and is inserted in the coupling hole 91, the interval between the upper body part 90*a* and the lower body part 90*b* can be adjusted. It can be fixed stable in response to the thickness of the side skin 2.

Moreover, a wire guide hole 93 may be formed at the other side of the upper body part 90*a* in the direction vertical to the coupling hole 91, and the wire (w) may be inserted in the wire guide hole 93 and may be guided.

The wire (w) will be connected in a zigzag shape since the guide part 90 is engaged to each shoestring hole 2*a*, and both ends of the wire (w) may be connected to the reel part 40. Here, since the reel part 40 rotates, the wire (w) will be wound around the reel part 40, thus tightening the side skins 2 of both sides of the shoe 1.

Since the wire guide hole 93 of the guide part 90 is provided in the direction vertical to the shoestring hole 2*a*, the wire (w) can be bent only in the leftward and rightward directions without bending upward and downward when it is inserted in the wire guide hole 93 and is connected in a zigzag shape.

In this way, since the friction force between the wire guide hole 93 and the wire (w) is reduced, a force required to tighten or loosen the side skins 2 of both sides of the shoe 1 can be also reduced in such a way to tighten or loosen the wire (w), as a result of which the convenience when the product is used can be improved.

Furthermore, the force can be evenly applied, thanks to the reduced friction force, in the directions of the top of the foot being near the wire tightening device 100 and of the toes being far from the wire tightening device 100 to which the tightening or loosening force is applied, for which the user can feel more stable and comfortable when wearing.

Meanwhile, it is preferred that a central portion of the inner surface 92 of the wire guide hole is formed protruding in a bulged and rounded shape in the outward direction of the shoe 1. For this reason, when the wire (w) is guided in a zigzag shape by the guide part 90 and is connected to the side skins 2 of both sides of the shoe 1, it can contact inclined with an end portion of the wire guide hole 93, whereupon the friction force can be more reduced when the wire (w) is tightened or loosened in response to the rotation of the reel part 40.

Figure 13:
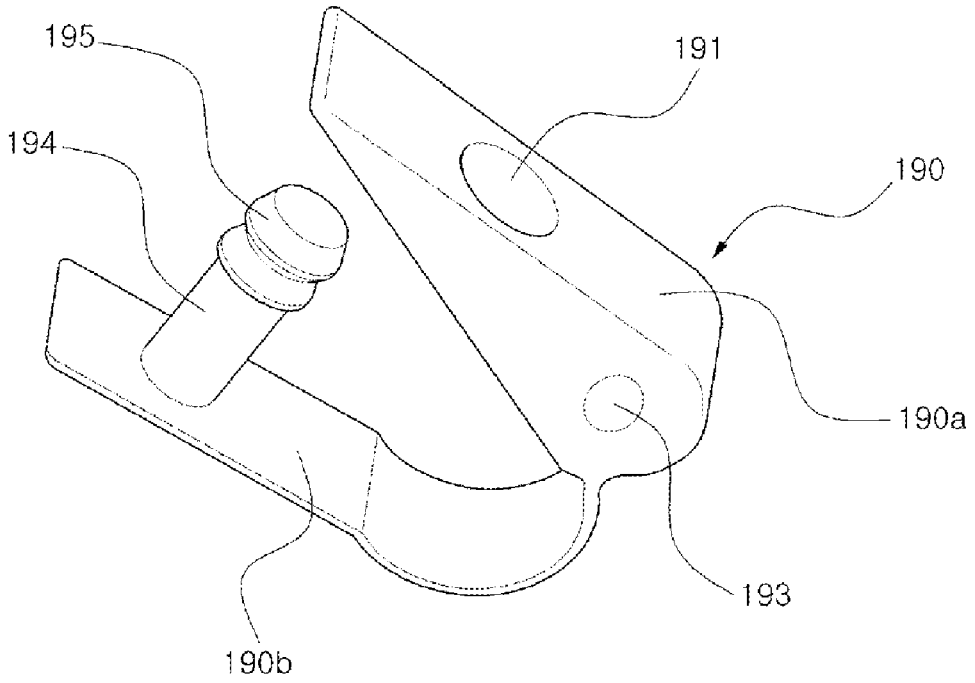
FIG. 13 is a perspective view illustrating a guide part of a wire tightening device according to another embodiment of the present invention.

FIG. 13 is a perspective view illustrating a guide part of the wire tightening device according to another embodiment of the present invention. In this embodiment, except for the configuration wherein an upper body part 190*a* and a lower body part 190*b* are provided integral, since the basic configurations are same as the previously described configurations, the descriptions on the same component will be omitted.

As illustrated in FIG. 13, the guide part 90 may include a lower body part 190*b* and an upper body part 190*a*. It is preferred that the lower body part 190*b* is formed restricted by a lower rim of the shoestring hole 2, and the insertion protrusion 194 passing through the shoestring hole 2 is formed protruding.

The upper body part 190*a* is provided integral with the lower body part 190*b* and is mounted on the upper rim of the shoestring hole 2, and an coupling hole 191 to which the insertion protrusion 194 is engaged may be formed at one side thereof. It is preferred that the coupling hole 191 is formed in response to the direction of the shoestring hole 2.

When the upper body part 190*a* is mounted on the upper rim of the shoestring hole 2, the insertion protrusion 194 of the lower body part 190*b* disposed at the lower rim of the shoestring hole 2 will pass through the shoestring hole 2 and will be fixedly inserted in the coupling hole 191.

it is preferred that a protruded hooking shoulder may be provided in the circumferential direction at an inner circumferential portion of the coupling hole 91, and a fixing shoulder hooking protrusion 195 which is hooked and engaged by the protruded coupling shoulder may be provided at the insertion protrusion 194.

Since the fixing shoulder hooking protrusion 195 is formed in a multiple-step structure and is inserted in the coupling hole 191, the interval between the upper body part 190*a* and the lower body part 190*b* can be adjusted, and it is can fixed stable in response to the thickness of the side skin 2.

Moreover, a wire guide hole 193 may be formed at the other side of the upper body part 190*a* in the direction vertical to the coupling hole 91, and the wire (w) will be inserted in the wire guide hole 193 and will be guided.

Since the wire guide hole 193 of the guide part 90 is formed in the direction vertical to the shoestring hole 2*a*, the wire (w) can be bent only in the leftward and rightward direction, not bending upward or downward when it is inserted in the wire guide hole 193 and is connected in a zigzag shape.

In this way, the friction force between the wire guide hole 193 and the wire (w) can be reduced, so the force required to tighten and loosen the side skins 2 of both sides of the shoe 1 can be reduced by tightening or loosening the wire (w), whereby the convenience when in use of the product can be improved.

The force can be evenly applied, thanks to the reduced friction force, in the directions of the top of the foot being near the wire tightening device 100 and of the toes being far from the wire tightening device 100 to which the tightening or loosening force is applied, for which the user can feel more stable and comfortable when wearing.

Figure 14:
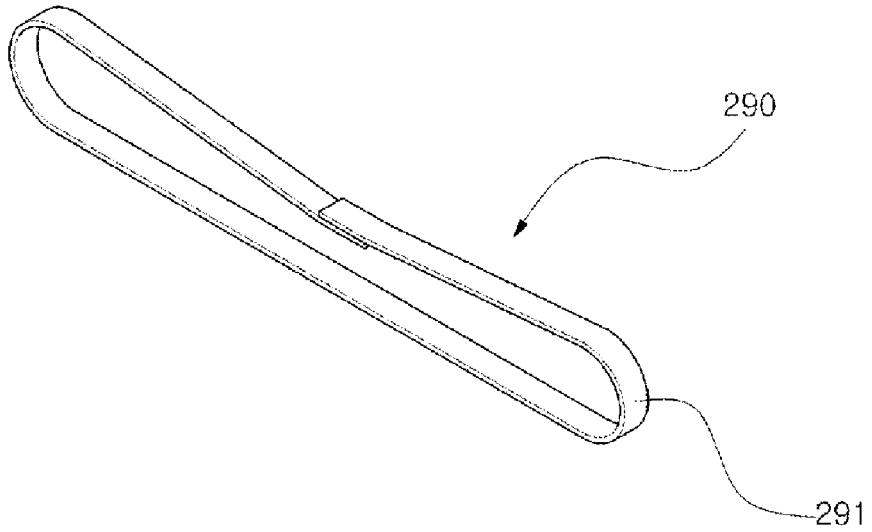
FIG. 14 is a perspective view illustrating a guide part of a wire tightening device according to further another embodiment of the present invention.
Figure 15:
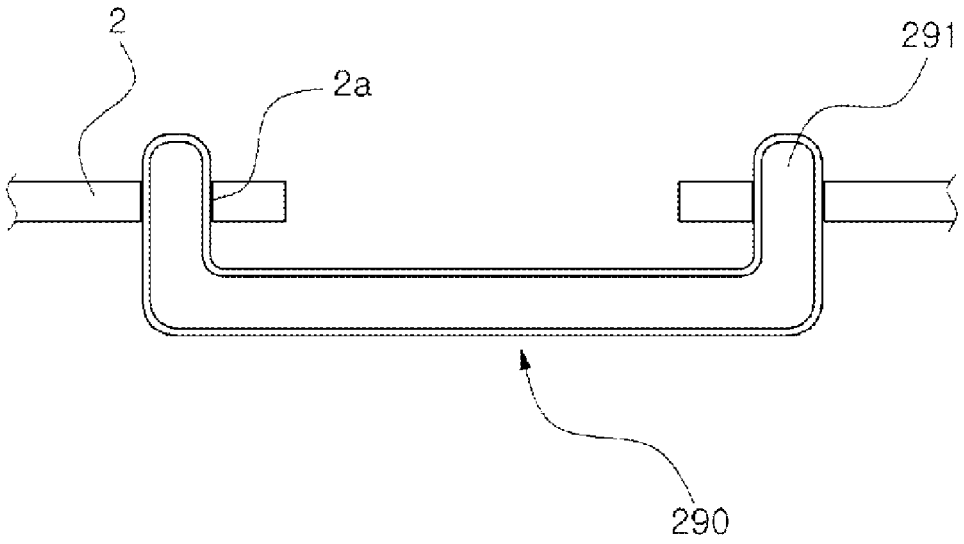
FIG. 15 is an example view illustrating an engagement of a guide part of a wire tightening device according to further another embodiment of the present invention.

FIG. 14 is a perspective view illustrating a guide part of a wire tightening device according to further another embodiment of the present invention. FIG. 15 is an example view illustrating an engagement of a guide part of a wire tightening device according to further another embodiment of the present invention.

In this embodiment, except for the configuration wherein the guide part 90 is formed of a guide band 290 and is engaged to a pair of the shoestring holes 2*a*, the basic configurations are same as the previously described configuration, so the descriptions on the same component will be omitted.

As illustrated in FIGS. 14 and 15, the guide part 90 is engaged to each pair of the shoestring holes 2*a* which are disposed facing each other, at the side skins 2 of both sides of the shoe 1. The guide part 90 is formed of a guide band 290, so both ends 291 will pass through from the lower side to the upper side of each pair of the shoestring holes 2*a* and will expose to the outside of the shoestring hole 2*a*.

The wire (w) may be inserted in the both ends 291 and will be guided. The wire (w) can be bent only in the leftward and rightward directions, not bending upward or downward since the wire (w) is inserted in the both ends 291 and is connected in a zigzag shape.

Since the friction force between the inner sides of the both ends 291 and the wire (w) can be reduced in the above mentioned way, the force required to tighten or loosen the side skins 2 of both sides of the shoe 1 can be reduced by tightening or loosening the wire (w), for which it is possible to improve the use convenience of the product.

Figure 16:
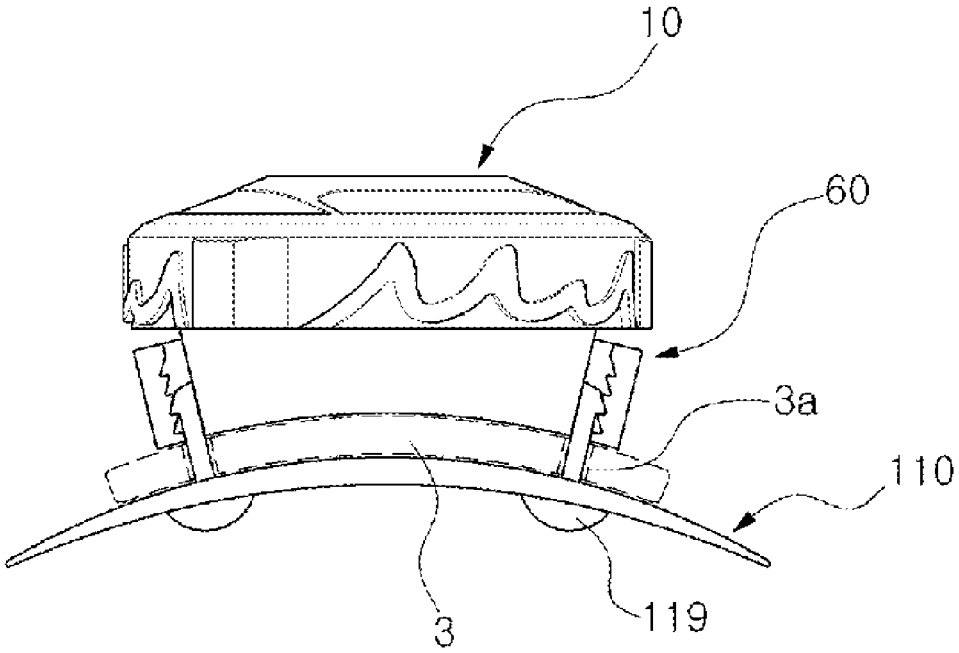
FIG. 16 is a side view illustrating a cushion part of a wire tightening device according to other embodiments of the present invention.

FIG. 16 is a side view illustrating a cushion part of the wire tightening device according to other embodiments of the present invention. In this embodiment, except for the configuration wherein a cushion part 119 is formed protruding from the lower surface of the pressing surface part 110, the basic configurations are same as the previously described configurations, so the descriptions on the same components will be omitted.

As illustrated in FIG. 16, it is preferred that the pressing surface part 110 is formed rounded in response to the shape of the top of the user's foot. Moreover, a cushion part 119 may be provided on the lower surface of the pressing surface part 110 and at a portion corresponding to the coupling bar, wherein the cushion part 119 can elastically transform when it contacts with the top of the user's foot.

It is preferred that the cushion part 119 is formed protruding in a semispherical shape for the cushion part 119 to be mounted on the upper side of the top of the foot. Since the top of the ordinary foot is formed inclined in terms of the shape of the top of the foot, the tongue 3 of the shoe in general tends to lean outward along the inclination of the top of the foot after a predetermined time passes after wearing.

When the wire (w) is tightened by rotating the rotary cover 10 of the wire tightening device 100, the pressing surface part 100 will contact close with the top of the user's foot. The portion protruding from the upper side of the top of the foot can be mounted and supported between the cushion parts 119 which are formed in parallel protruding in the semispherical shapes from both lower sides of the pressing surface part 110.

Since the cushion parts 119 are able to support from both sides the portion protruding from the top of the foot in the above described way, the pressing surface part 110 can be fixed in place without separating from the upper side of the top of the foot. For this reason, since the tongue 3 does not lean outward of the top of the foot even though a predetermine time passes after wearing, any muscle ache can be prevented, and a comfortable wearing feeling can be provided.

Since the cushion part 119 is disposed at a lower portion of the coupling part and is elastically transformed, any pressing feeling and impact applied to the top of the foot due to the coupling part can be alleviated, whereupon the top of the foot can be supported comfortable even though the wire (w) is tightly tightened, thus improving the convenience of the product.

Moreover, since the cushion part 119 is supported by the top of the user's foot in order to prevent the tongue 3 from moving when the rotary cover 10 rotates in one direction to tighten the wire (w), the driving to tighten the wire (w) can be stably carried out, which may result in the improved convenience when in use of the product.

Since the cushion part 119 forms a space between the tongue 3 and the top of the user's foot as the cushion part 119 elastically recovers when the wire (w) is loosened by rotating the rotary cover 19 in the other direction, the wire (w) can be loosened by easily pulling the tongue 3, by means of which the use convenience of the product can be improved.

The mounting method of the wire tightening device 100 will be described in more detail with reference to FIGS. 3 to 9.

First, a provision hole 3*a* is formed at the tongue 3 of the shoe 1 at a previously set interval. It is preferred that the provision hole 3*a* is formed in response to the positions of the coupling parts 120 and 220 formed at the rim of the housing part 60.

The provision hole 3*a* may be formed in such a way to cut using a knife or may be formed using a punch, etc. The rim of the formed provision hole 3*a* can be fixed not to be torn off in such a way to melt it with heat.

If the provision hole 3*a* is formed, the housing part 60 is mounted on the upper surface of the tongue 3 in order for the coupling parts 120, 220 and 320 formed at the housing part 60 to be disposed in response to the provision hole 3*a*.

Thereafter, the pressing surface parts 110, 210 and 310 are disposed on the lower surface of the tongue 3. As illustrated in FIGS. 3 to 6, the pressing surface parts 110 and 210 may be provided separate, and may be disposed on the lower surface of the tongue 3. As illustrated in FIGS. 7 and 8, the pressing surface part 310 may be bent covering a side end portion of the tongue 3, and then the pressing surface part 310 may be disposed on the lower surface of the tongue 3.

The coupling bars 112, 212 and the second coupling bar 311 formed protruding from the pressing surface parts 110, 210 and 310 may pass through the provision hole 3*a* and may be engaged to the coupling parts 120, 220 and 320, thus fixing the wire tightening device 100 at the tongue.

Since the user is able to form the provision hole 3*a* at the tongue 3 irrespective of the thickness of the tongue 3, and the coupling bars 112, 212 and the second coupling bar 311 may pass through the provision hole 3*a* and then may be inserted into the coupling parts 120, 220 and 320, which can be carried via a simplified procedure, so the present invention can be employed to various shoes 1, thus improving product compatibility and convenience during mounting.

The wire tightening device can be inserted in stages with the aid of the protrusions formed in a multiple-step structure so as to adjust the intervals between the pressing surface parts 110, 210 and 310 and the coupling parts 120, 220 and 320. In this way, the wire tightening device can be fixed stable in response to the tongue 3 having different thicknesses without carrying out any sewing procedure, for which the wire (w) can be stably tightened or loosened, thus improving the safety of the product.

Referring to FIGS. 9 and 10, an end portion of the wire (w) is connected to the reel part 40 so that the wire (w) to which the guide part 90 is engaged can be wound during the rotation of the reel part 40.

More specifically, the wire tightening device 100 is provided in a state where the wire (w) is connected to the reel part 40. A plurality of the guide parts 90 are engaged to the wire (w).

The upper body part 90*a* of each guide part 90 may be disposed at the rim of the upper portion of each shoestring hole 2*a* in order for the wire (w) to be connected to the side skins 2 of both sides of the shoe 1 in a zigzag shape, and the lower body part 90*b* may be disposed at the rim of the lower portion.

The guide part 90 can be fixed at the shoestring hole 2*a* in such a way that the insertion protrusion 94 passes through the shoestring hole 2*a* and is engaged to the coupling hole 91. When the wire (w) fixed at the wire tightening device 100 is connected in a zigzag shape, the guide part 90 is disposed at each shoestring hole 2*a*, and the insertion protrusion 94 is inserted, thus finishing an assembling procedure, which makes it possible to improve the use convenience of the product.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A wire tightening device on a shoe, comprising:

the shoe including a tongue and side skins on either side of the tongue;

a housing part including a cylindrical inner surface, wherein a ratchet gear is provided at an inner circumferential portion of the housing part, and a shaft extends from a lower inner surface of the housing part;

a reel part which is rotatable and disposed at an inner portion of the housing part such that the shaft of the housing part extends through the reel part, and the reel part is able to supply a tensile force to a wire to tighten the side skins of the shoe as the wire is wound;

and a rotary cover which is provided to selectively rotate the reel part, the rotary cover being located above the reel part, wherein the housing part is mounted on an upper surface of the tongue, and includes a coupling part formed at either side of the housing part that aligns with a provision hole formed at either side of the tongue and through the tongue, wherein the wire tightening device further includes a pressing surface part that is located under the tongue to pressurize a lower surface of the tongue and includes a coupling bar protruding from either side of the pressing surface part, the coupling bar on either side of the pressing surface part passing through the provision hole at either side of the tongue to engage with the coupling part so as to fixedly clamp the tongue, wherein the coupling part comprises an insertion groove part into which the coupling bar is inserted, wherein a coupling protrusion extends from an inner portion of the insertion groove part, wherein a lower surface of the coupling protrusion is inclined, and an upper surface of the coupling protrusion is flat, and wherein a ratchet protrusion extends from the coupling bar and engages with the coupling protrusion, such that the ratchet protrusion is configured to slide on the lower surface of the coupling protrusion when the coupling part is pressed downward toward the tongue to engage the pressing part and clamp the tongue, and wherein the ratchet protrusion is configured to provide resistance against the upper surface of the coupling protrusion when the coupling part is pulled upward away from the tongue, thus restricting upward movement and fixedly clamping the wire tightening device on the shoe.

2. The device of claim 1, wherein the coupling protrusion is a multiple-step structure formed along a direction that the coupling bar is inserted, and wherein wedge protrusions extend from a lower surface of the housing part and from an upper surface of the pressing surface part so as to pressurize and restrict by gripping the tongue.

3. The device of claim 1, wherein the shoe further comprises shoestring holes formed along the side skins of the shoe, and a guide part engaged to each of the shoestring holes, the guide part comprising a lower body part, wherein an insertion protrusion of the guide part passes through each of the shoestring holes and the lower body part of the guide part is restricted from passing through each of the shoestring holes by a lower portion rim of each of the shoestring holes, the guide part further comprising an upper body part which is mounted on an upper portion rim of each of the shoestring holes, wherein the upper body part comprises a coupling hole to which the insertion protrusion is engaged, the coupling hole being located at one side of the upper body part, and a wire guide hole is formed at the other side of the upper body part such that the wire guide is perpendicular to the coupling hole in order for the wire to be inserted.

4. The device of claim 1, wherein the shoe further comprises a pair of shoestring holes formed on the side skins of the shoe, wherein a guide part is engaged to each of the pair of the shoestring holes.

5. The device of claim 1, wherein the pressing surface part is rounded such that it is configured to conform to a top of a user's foot, and includes a cushion part which is provided on a lower surface of the pressing surface part at a location corresponding to the coupling bar and is capable of bending when worn such that the cushion part is configured to conform with the top of the user's foot, and the cushion part is formed in a semispherical shape to allow for the pressing surface part to be mounted on the top of the foot.

6. A method for mounting a wire tightening device, comprising:

a first step wherein a provision hole is formed through a tongue of a shoe, the shoe including side skins on either side of the tongue;

a second step wherein a housing part is mounted on an upper surface of the tongue such that a coupling part of the housing part is aligned with the provision hole, wherein a reel part is provided to supply a tensile force to a wire to tighten the side skins of the shoe as it is wound, the reel part being rotatable and disposed at the housing part;

and a third step wherein a pressing surface part that is located under the tongue and is configured to pressurize a lower surface of the tongue as a coupling bar protruding from either side of the pressing surface part passes through the provision hole and is engaged to the coupling part so as to fixedly clamp the tongue, wherein the coupling part comprises an insertion groove part into which the coupling bar is inserted, wherein a coupling protrusion extends from an inner portion of the insertion groove part, wherein a lower surface of the coupling protrusion is inclined, and an upper surface of the coupling protrusion is flat, and wherein a ratchet protrusion extends from the coupling bar and engages with the coupling protrusion, such that the ratchet protrusion is configured to slide on the lower surface of the coupling protrusion when the coupling part is pressed downward toward the tongue to engage the pressing part and clamp the tongue, and wherein the ratchet protrusion is configured to provide resistance against the upper surface of the coupling protrusion when the coupling part is pulled upward away from the tongue, thus fixedly clamping the wire tightening device on the shoe.

7. The method of claim 6, the method further comprises a fourth step wherein the wire is provided and an end portion of the wire is connected to the reel part in order for the wire to be wound during the rotation of the reel part.

* * * * *